US009440120B2

(12) United States Patent
Lee

(10) Patent No.: US 9,440,120 B2
(45) Date of Patent: Sep. 13, 2016

(54) BALL HOLDER FOR TABLE TENNIS TABLES

(71) Applicant: Richard Lee, Rockville, MD (US)

(72) Inventor: Richard Lee, Rockville, MD (US)

( * ) Notice: Subject to any disclaimer, the term of this patent is extended or adjusted under 35 U.S.C. 154(b) by 56 days.

(21) Appl. No.: 14/331,796

(22) Filed: Jul. 15, 2014

(65) Prior Publication Data

US 2015/0141176 A1 May 21, 2015

Related U.S. Application Data

(60) Provisional application No. 61/906,318, filed on Nov. 19, 2013.

(51) Int. Cl.
*A63B 47/00* (2006.01)
*A47B 25/00* (2006.01)

(52) U.S. Cl.
CPC ..... *A63B 47/002* (2013.01); *A47B 25/003* (2013.01); *A63B 2102/16* (2015.10); *A63B 2209/14* (2013.01); *A63B 2210/50* (2013.01)

(58) Field of Classification Search
CPC .... A63B 47/00; A63B 47/02; A63B 47/002; A63B 71/00; A63B 71/0045; A63B 2102/16; A63B 2209/14; A63B 2210/50; A63B 2243/0091; A47B 25/003
USPC ..... 473/496; 206/315.9; 211/13.1, 14, 85.7; 52/11
See application file for complete search history.

(56) References Cited

U.S. PATENT DOCUMENTS

| | | | | |
|---|---|---|---|---|
| 2,569,007 | A * | 9/1951 | Klyce | A47B 25/003 108/170 |
| 3,853,316 | A * | 12/1974 | Smith | A63B 47/00 221/64 |
| D246,340 | S | 11/1977 | Frank | |
| 4,125,192 | A * | 11/1978 | Dayen | A63B 71/0045 211/14 |
| D258,182 | S | 2/1981 | Thorne | |
| 5,472,189 | A | 12/1995 | Pfeiffer et al. | |
| 5,632,386 | A * | 5/1997 | Gabhart | A63B 71/0045 211/14 |
| 5,820,499 | A | 10/1998 | Thomas et al. | |
| D457,371 | S | 5/2002 | Grassman | |
| 7,213,724 | B1 | 5/2007 | Langer | |
| 8,157,677 | B1 | 4/2012 | Chen | |
| 8,414,431 | B2 | 4/2013 | Chung | |
| 2014/0332484 | A1* | 11/2014 | Durant | A63B 71/0045 211/85.7 |
| 2015/0141176 | A1* | 5/2015 | Lee | A63B 47/002 473/496 |
| 2016/0016049 | A1* | 1/2016 | Kettler | A47B 25/003 473/496 |

* cited by examiner

*Primary Examiner* — Raleigh W Chiu
(74) *Attorney, Agent, or Firm* — Muskin & Farmer LLC

(57) ABSTRACT

A ball holder for a table tennis table designed for non-intrusive mounting under a corner of a table tennis table. The ball holder can be manufactured in two parts for ease of sale and construction, with the two halves being easily assembled and secured by the user. The two halves can connect using a set of male and female tabs, and secure using a set of bolts. The full assembly can attach to the table tennis table through the use of four screws. Properly assembled, the ball holder can contain multiple table tennis balls in an easily accessible position, but without obstructing the players' range of motion or creating a hazard.

6 Claims, 5 Drawing Sheets

BALL HOLDER FOR TABLE TENNIS TABLES

CROSS REFERENCE TO RELATED APPLICATIONS

This application claims benefit to provisional patent application no. 61/906,318 filed Nov. 19, 2013, which is incorporated by reference herein in its entirety.

FIELD OF THE INVENTION

The holder is used to keep a few table tennis balls connected to a table tennis table in a way that is convenient for use, but does not create interference with the players.

BACKGROUND

During the game of table tennis, two players are positioned on opposite sides of a table and a ball is hit between the two players over a net. Often, when one of the players scores a point the ball travels to a location remote from the table, often becoming lost under furniture. When this happens the flow of the game is interrupted as one of the players must retrieve the ball before the game play can resume.

Several ball storage devices have been designed to be solutions to this problem, such as the devices disclosed in U.S. Pat. No. 8,414,431 (Chung) and U.S. Pat. No. 8,157,677 (Chen). However, each of these designs has drawbacks that make their use less practical. For example, the Chung et al. patent ('431) discloses a ball storage and holding device that is located along the bottom of the ends of the table tennis table. This location is convenient for a player to remove a ball for use, but the location can create interference with the player while they are playing as the device reduces the amount of space located below the end of the table. This change may not be expected by the user, resulting in the user's leg coming into contact with the holder, which can disrupt play or possibly even cause injury.

The Chen patent ('677) does not share this drawback with the Chung et al. patent ('431) because the Chen holder is located on the side of the table. The holder is affixed adjacent to the net, which is located at the midpoint of the table, and can be used to hold both balls and paddles. This storage device is useful to hold loose elements that are used in the game while the game is not being played. However, a device that stores the balls at a location close to the net is not practical for use during a game. The flow of play would not be consistent if players had to reach all the way up to the net in order to get another ball to serve at the end of a point, as service occurs at the edges of the table rather than near the net. This solution would not be much more efficient than playing the game without a ball holder and retrieving the lost ball after each play. Therefore, although the holder disclosed in Chen will not create interference based on its location, it is not practical for use for ball storage during a game.

What is needed is a ball storage device that is convenient for use during a table tennis game, but does not create interference with the player while the game is being played.

SUMMARY OF THE INVENTION

It is an aspect of the present device to perform as a ball holder that is convenient for use during a table tennis game, but does not create interference with the player while the game is being played.

The above aspect can be achieved by a ball holder for a table tennis table comprising: a top piece wherein the top piece further comprises a flat-top surface with a missing corner, and an L-shaped underside, and a bottom piece wherein the bottom piece is L-shaped.

The above aspect can also be achieved by a method of using a ball holder for a table tennis table, comprising the steps of: obtaining a table tennis table with at least one corner; obtaining a ball holder for a table tennis table having a top piece, and a bottom piece; affixing said top piece to said corner of said table tennis table; and attaching said bottom piece to said top piece.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which.

DETAILED DESCRIPTION

Figure 1:
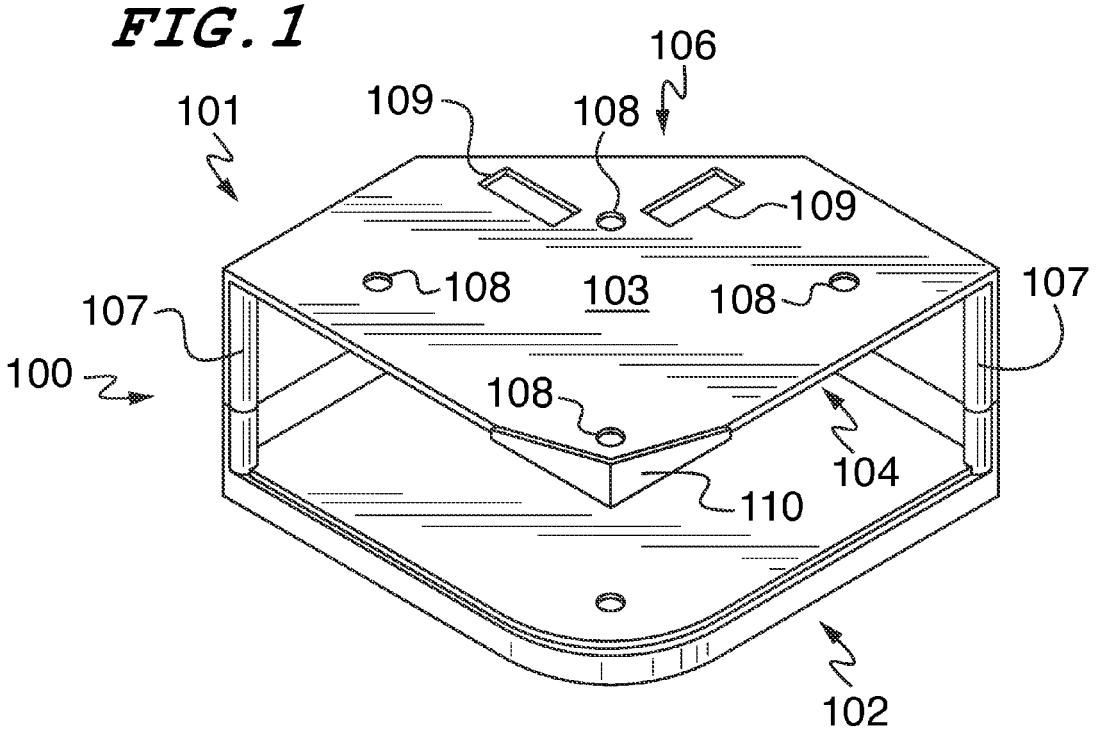
FIG. 1 is a perspective view of the top and front of an ball holder for a table tennis table according to an embodiment.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The present device can be a ball holder that can be configured to hold one or more table tennis balls under one or more corners of a table tennis table. In an embodiment, the ball holder can be L-shaped with the inside of the L having a right angle and both legs having the same length.

The distance between the inside and the outside edges and the length of each leg can be sufficient to hold a table tennis ball. A third ball can be secured at the point of the L, which would correspond to the corner of the table tennis table. In an embodiment, the entire ball holder can be secured to the table through the use of screws or any other suitable attachment device or system that can firmly hold affix the holder to the underside of the corner of the table tennis table. The location of the ball holder under the corner of the table tennis table ensures that it is out of the way and cannot interfere with the player during game play. Additionally, the ball holder can either be manufactured as part of a table tennis table, or can be configured to be an after-market accessory designed to be added to a table by an end use consumer.

Reference will now be made in detail to the present embodiments of the invention, examples of which are illustrated in the accompanying drawings.

FIG. 1 is a front and top perspective view of a ball holder 100 for a table tennis table according to an embodiment. In an embodiment, the present ball holder 100 can comprise two pieces, which can connect to form its body, a bottom piece 102 and a top piece 101. The top piece 101 and bottom piece 102 can be comprised of plastic, wood, metal, or any other suitable material. In an embodiment, an opening can be created between the top piece 100 and the bottom piece 102. The top piece 101 can have a flat top surface 103 that can be roughly square in shape with one corner of the square missing.

In an embodiment, the top piece 101 of the ball holder 100 can comprise one or more screw holes 108. These screw holes 108 can be used to affix the ball holder 100 to a table tennis table (not shown). Bolt holes 107 can be located at the outside corners of each of the L-shaped legs 105 of the underside 104. Two slots 109 can be located in the part of the top piece 101 that is not located over the L-shaped underside 104.

The front corner of the top piece 101, which is the corner opposite of the removed corner can comprise a reinforcing support member 110. The reinforcing support member 110 can be comprised of a single molded piece of plastic that is affixed to the top piece 101 on the outside of the front corner. The reinforcing support 110 can extend up from the top of the top piece 101. The purpose of this element is to cover the corner of the table tennis table (not shown) and provide additional support for the ball holder 100. In an embodiment, the corner of the reinforcing support member 110 can be slightly rounded, so that it is not sharp and not cause injury to a player if he or she would come into contact with the corner of the ball holder 100 or table tennis table (not shown). In an alternative embodiment the reinforcing support member 110 can be comprised of or covered with a soft material, such as foam or rubber, which can provide further protection against injury.

Figure 2:
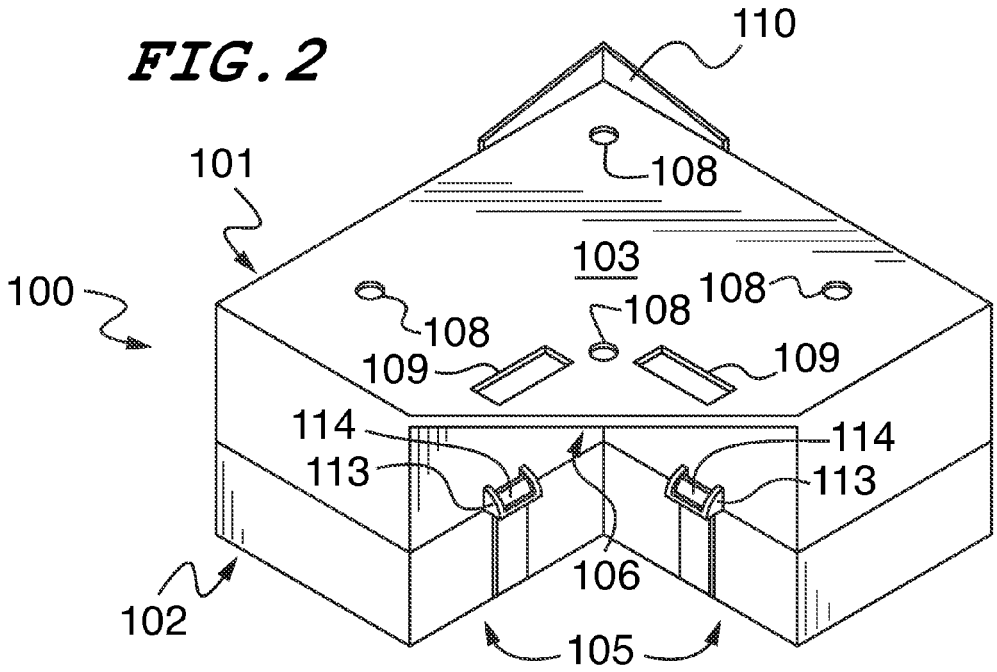
FIG. 2 is a perspective view of the top and rear of a ball holder for a table tennis table according to an embodiment.

FIG. 2 is a perspective view of the top and back of a ball holder 100 for a table tennis table according to an embodiment. In an embodiment, the bottom piece 102 can be L-shaped and the bottom piece 102 and the underside of the top piece 101 can be aligned with one another and secured together to form the ball holder 100. The male tabs 114 and female tabs 113 can be configured to securely connect with each other to hold the inside edges of the bottom piece 102 and the top piece 101 together. The outside edges of the bottom piece 102 and top piece 101 can be secured to one another through the use of bolts or other attachments devices (not shown in this figure) located in the bolt holes 107.

Affixed to the top piece 101 can be two female tabs 113, one located on each edge, according to an embodiment. The female tabs 113 can be rectangular in shape with an open slot in the middle of the rectangle. Each tab 113 can extend away from the front corner and be located under the triangle 106 of the top surface 103 that does not cover the L-shaped underside. The female tabs 113 can be used to secure the top piece 101 to the bottom piece 102 and the screw holes 108 can be used to secure the entire ball holder 100 to the underside of the table tennis table (not shown).

Figure 3:
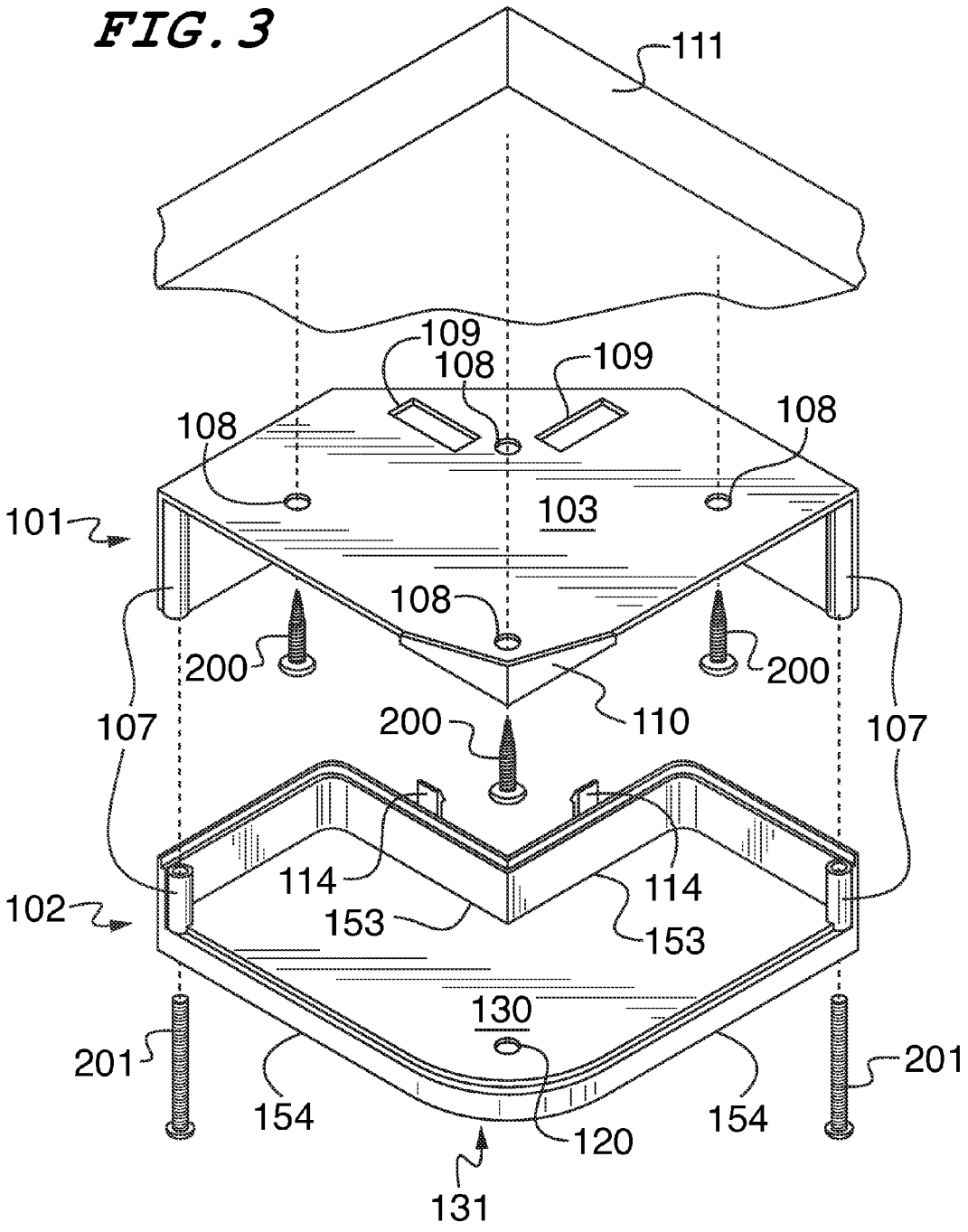
FIG. 3 is a perspective exploded view of a ball holder for a table tennis table according to an embodiment.

FIG. 3 is a perspective exploded view of a ball holder 100 for a table tennis table according to an embodiment. In an embodiment, the bottom piece 102 can form an L-shape with inside edges 153 and outside edges 154. The length of the inside edges 153 can be equal to each other. The length of the outside edges 154 can be equal to each other. The length of each inside edge 153 can be approximately the equal to the length of a table tennis ball's (not shown) diameter. Additionally, the length of each of the outer edges 154 can be approximately equal to two times the diameter of a standard table tennis ball (not shown). The height of the bottom piece 102 can be smaller than the diameter of a table tennis ball (not shown). The combined heights of the top piece 101 and the bottom piece 102, when added to each other, can be approximately equal to the diameter of a table tennis ball (not shown).

A bolt hole 107 can be located at the outer corner of each outside edge 154, according to an embodiment. Each bolt hole 107 can extend the entire height of the bottom piece 102. Two male tabs 114 can be located along the topside of each inside edge 153. One male tab 114 can be located approximately in the middle of each inside edge 153. This location can correspond to the location of the female tabs (not shown) on the underside of the top piece 101. The top piece 101 can be secured to the bottom piece 102 by interlocking the male tabs 114 with the female tabs (not shown). The bottom piece 102 and top piece 101 can be secured by inserting bolts 201 into the bolt holes 107. The top piece 101 can be secured to the table tennis table 111 by inserting screws 200 into the screw holes 108.

Figure 4:
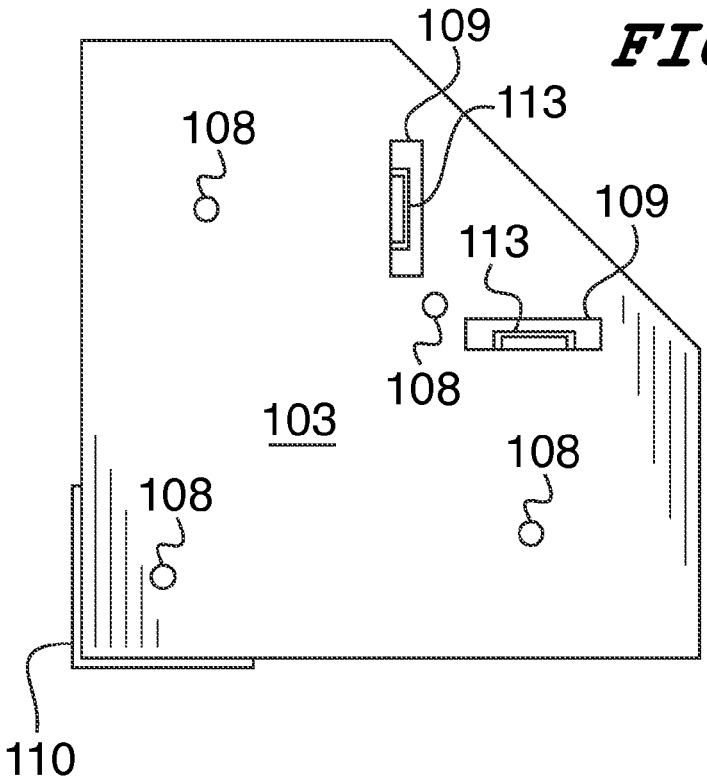
FIG. 4 is a top view of the top piece of a ball holder for a table tennis table according to an embodiment.

FIG. 4 is a top view of the top piece 101 of a ball holder 100 for a table tennis table according to an embodiment. In an embodiment, the top piece 101 can have a flat top surface 103 that can be square in shape. For attachment to a table tennis table 111, the flat surface 103 of the top piece 101 can be held securely against the underside of the playing surface of a table tennis table 111 through the use of four screws (not shown) inserted through the four screw holes 108. The reinforcing support member 110 can be pushed securely against the corner of the table tennis table 111. From this view, the female tabs 113 can be seen through the two slots 109.

Figure 5:
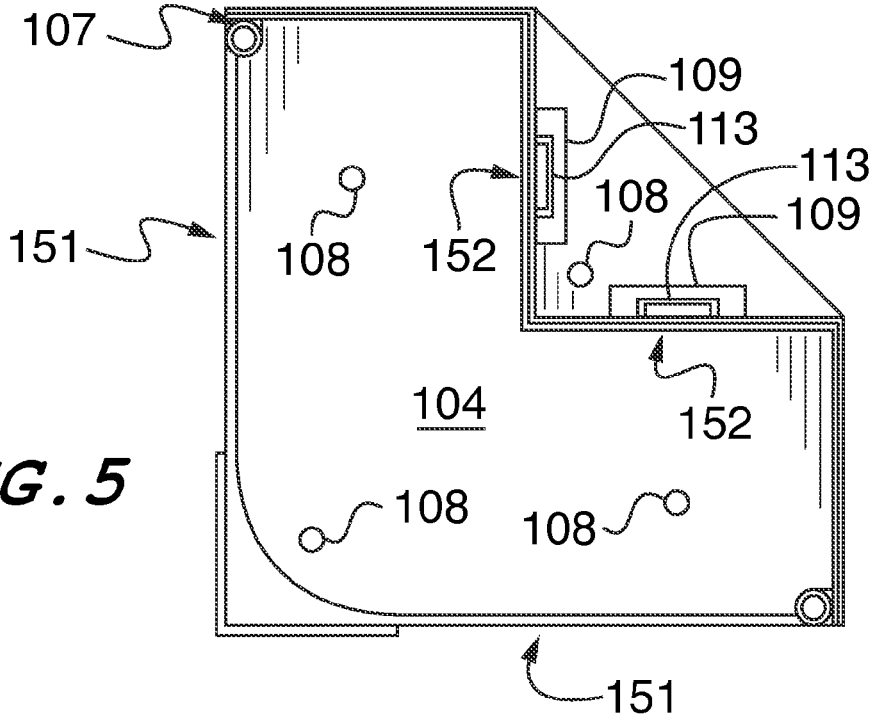
FIG. 5 is a bottom view of the top piece of a ball holder for a table tennis table according to an embodiment.

FIG. 5 is a bottom view of the top piece 101 of a ball holder 100 for a table tennis table according to an embodiment. The underside 104 of the top piece 101 can be L-shaped and mirror the image of the L-shape of the bottom piece (not shown in FIG. 5). The underside 104 of the top piece 101 can have an L-shape with inside edges 150 and outside edges 151. The length of the inside edges 150 can be equal to each other. The length of the outside edges 151 can be equal to each other. The length of the inside edges 150 can be approximately the equal to the length of a table tennis ball's (not shown) diameter. Additionally, the length of the outer edges 151 can be approximately equal to two times the diameter of a standard table tennis ball (not shown). The inside edges 150 and outside edges 151 of the underside 104 of the top piece 101 and the bottom piece (not shown) can be attached to each other. The height of the underside 104 of the top piece 101 can be smaller than the diameter of a table tennis ball (not shown). The height of the underside 104 of the top piece 101 and the height of the bottom piece (not shown) added to each other can be approximately equal to the diameter of a table tennis ball (not shown).

The under surface 104 of the top piece 101 can be covered in a foam material (not shown), or any other material that has some elasticity, such that it can be compressed slightly to provide sufficient space for a table tennis ball 250 to be inserted into the ball holder 100. The top piece 101 can be secured to the bottom piece (not shown) through the use of two bolts (not shown) that can be threaded through the two bolt holes 107, located at the outer corners of the outside edges 151. The top piece 101 can be secured to the table tennis table (not shown) by the use of four screws (not shown) inserted through the screw holes 108.

In an embodiment, the top piece 101 can have two female tabs 113, which can be located on the midpoint of the inside edges 152. The female tabs 113, from this view, are in line with the two slots 109. The inside edges 152 extend to touch the inside edges (not shown) of the bottom piece (not shown) when connected.

Figure 6:
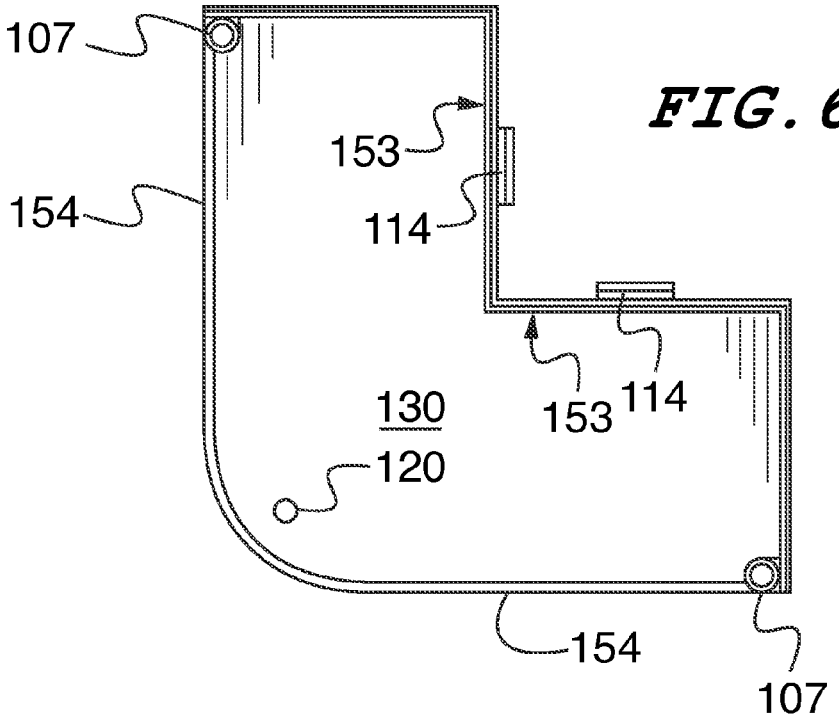
FIG. 6 is a top view of the bottom piece of a ball holder for a table tennis table according to an embodiment.

FIG. 6 is a top view of the bottom piece 102 of a ball holder 100 for table tennis, according to an embodiment. In an embodiment, the bottom piece 102 can be a rounded L-shape, and can have inside edges 153 and outside edges 154. The inside edges 153 can extend such that they can connect with the inside edges (not shown) of the top piece (not shown) when connected. The inner surface 130 of the bottom piece 102 can be covered in a foam material (not shown), or any other material that has some elasticity, such that it can be compressed slightly to provide sufficient space for a table tennis ball 250 to be inserted into the device 100. The bottom piece 102 can be attached to the top piece (not shown) by snapping the male tabs 114, located at the midpoints of the inside edges 153, to the female tabs (not shown) on the top piece (not shown). The bottom piece 102 can be secured using two bolts (not shown) inserted through the bolt holes 107.

Figure 7:
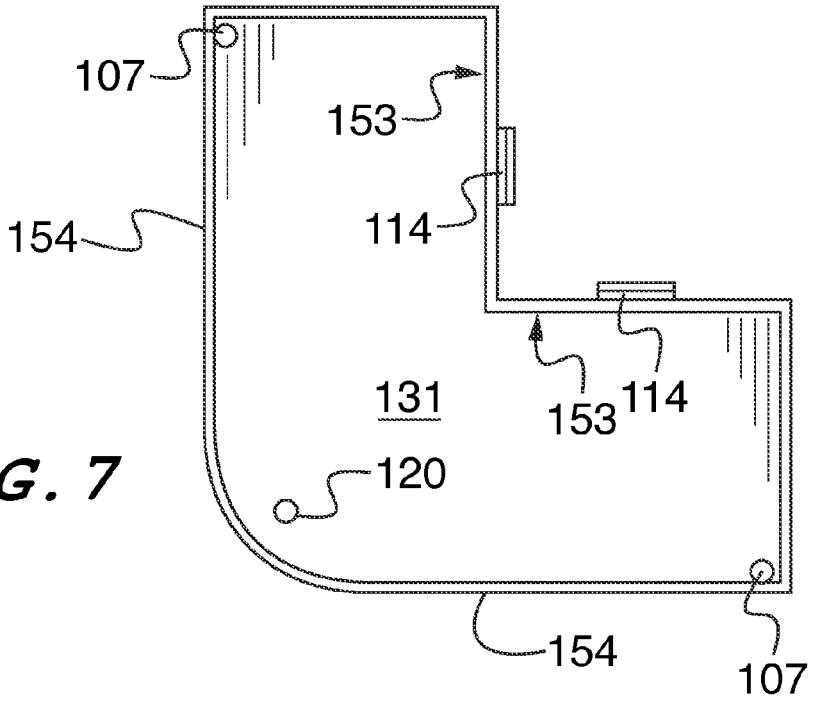
FIG. 7 is a bottom view of the bottom piece of a ball holder for a table tennis table according to an embodiment.

FIG. 7 is a bottom view of a bottom piece 102 of a ball holder 100 for table tennis, according to an embodiment. The bottom piece 102 can be shaped like a rounded L and the underside 131 of the bottom piece 102 can be bounded by outside edges 154 and inside edges 153. The bottom piece 102 can be attached to the top piece (not shown) by snapping the male tabs 114, located at the midpoints of the inside edges 153, to the female tabs (not shown) on the top piece (not shown). The bottom piece 102 can be secured using two bolts (not shown) inserted through the bolt holes 107.

Figure 8:
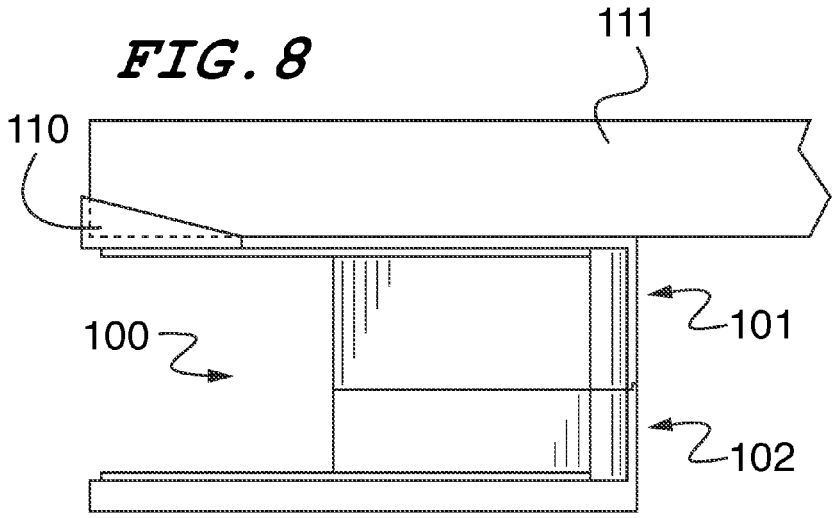
FIG. 8 is a side view of an ball holder for table tennis affixed to a table tennis table according to an embodiment.

FIG. 8 is a side view of a ball holder 100 for table tennis affixed to a table tennis table 111 according to an embodiment. The ball holder 100 can be attached to the table tennis table 111 during manufacture. Specifically, screws 200 (not shown) can be used to attach the top piece 101 to the underside of the table tennis table 111. Additionally, the reinforcing support member 110 placed against the outside corner of the table tennis table 111 can provide additional securement of the ball holder 100 to the table 111.

Figure 9:
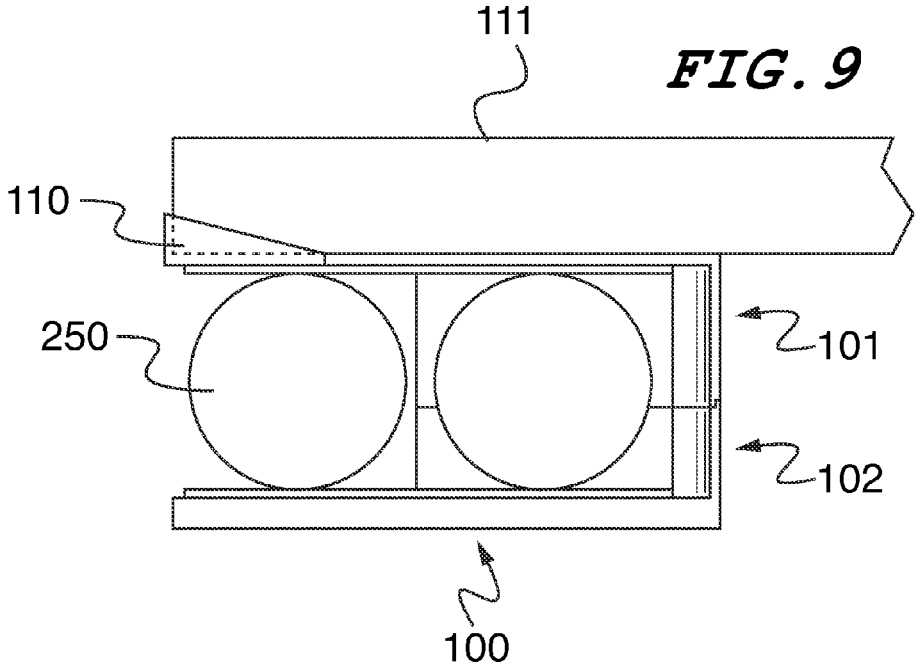
FIG. 9 is a side view of a ball holder for table tennis affixed to a table tennis table containing table tennis balls according to an embodiment.

FIG. 9 is a side view of a ball holder 100 for table tennis affixed to a table tennis table 111 and loaded with table tennis balls 250 according to an embodiment. The ball holder 100 can be attached to the table tennis table 111 during manufacture. Specifically, screws 200 (not shown) can be used to attach the top piece 101 to the underside of the table tennis table 111. Additionally, the reinforcing support member 110 placed against an outside corner of the table tennis table 111 can provide additional securement of the ball holder 100 to the table 111.

At least three table tennis balls 250 can be secured in the ball holder 100 and easily accessible to the player (not shown). A ball 250 can be placed in the ball holder 100 by manually pushing it within the inside of the ball holder 100. Foam material (not shown) lining the top 101 and bottom 102 of the inside can be compressed such that it allows the ball 250 to be placed within and easily removed from the holder 100. The compression of the foam material (not shown) also can securely hold the ball 250 during play.

The many features and advantages of the inventive concept are apparent from the detailed specification and, thus, it is intended by the appended claims to cover all such features and advantages of the concept that fall within its true spirit and scope. Further, since numerous modifications and changes will readily occur to those skilled in the art, it is not desired to limit the inventive concept to the exact construction and operation illustrated and described, and accordingly all suitable modifications and equivalents may be resorted to, falling within the scope of the inventive concept.

What is claimed is:

1. A ball holder for a table tennis table comprising:

a top piece wherein the top piece further comprises a roughly square flat-top surface with a missing corner, and an L-shaped underside, and;

a bottom piece wherein the bottom piece is L-shaped.

2. The ball holder as recited in claim 1, wherein the top piece further comprises at least one bolt hole, and at least one screw hole.

3. The ball holder as recited in claim 1, wherein the top piece further comprises a reinforcing support member.

4. The ball holder as recited in claim 1, wherein the holder is partially covered by a foam material.

5. The ball holder as recited in claim 1, wherein the top piece further comprises a first female tab and a second female tab, and;

the bottom piece further comprises a first male tab and a second male tab.

6. The ball holder of claim 5, further comprising a first male tab attached to the first female tag, and a second male tag attached to the second female tag.

* * * * *